US009228770B2

(12) United States Patent
Owens

(10) Patent No.: US 9,228,770 B2
(45) Date of Patent: Jan. 5, 2016

(54) BLANKET FOR CRYOGENICALLY COOLING AT LEAST A PORTION OF A WORKPIECE

(71) Applicant: The Boeing Company, Chicago, IL (US)

(72) Inventor: Helen M. Owens, Philadelphia, PA (US)

(73) Assignee: The Boeing Company, Chicago, IL (US)

( * ) Notice: Subject to any disclaimer, the term of this patent is extended or adjusted under 35 U.S.C. 154(b) by 195 days.

(21) Appl. No.: 13/757,549

(22) Filed: Feb. 1, 2013

(65) Prior Publication Data

US 2014/0216070 A1 Aug. 7, 2014

(51) Int. Cl.
*F25D 31/00* (2006.01)
*F25D 3/10* (2006.01)

(52) U.S. Cl.
CPC ..... *F25D 3/10* (2013.01)

(58) Field of Classification Search
CPC ..... F25B 19/005; F25B 3/10; F25B 3/107; F25B 31/002; F25B 19/02
USPC ..... 62/64, 373, 52.1
See application file for complete search history.

(56) References Cited

U.S. PATENT DOCUMENTS 3,556,174 A * 1/1971 Gibble et al. ..... 141/69
3,619,340 A * 11/1971 Jones ..... 428/166
3,847,208 A * 11/1974 Ollendorf ..... 165/47
4,220,012 A * 9/1980 Brister ..... 62/130
4,370,862 A * 2/1983 Brister ..... 62/66
4,739,622 A 4/1988 Smith
5,561,986 A * 10/1996 Goodall ..... 62/406
5,775,110 A * 7/1998 Waldron ..... 62/50.2
5,870,897 A * 2/1999 Barr et al. ..... 62/52.1
6,220,286 B1 * 4/2001 Davenport ..... 137/561 A
D681,807 S 5/2013 Niedbala et al.
2006/0271028 A1 * 11/2006 Altshuler et al. ..... 606/9
2006/0289493 A1 * 12/2006 Thomas et al. ..... 219/660
2007/0125463 A1 * 6/2007 Kohasko et al. ..... 148/630
2007/0214625 A1 * 9/2007 Brown et al. ..... 29/91.1

FOREIGN PATENT DOCUMENTS

EP 2 476 978 A1 7/2012
JP 2000 262262 A 9/2000

OTHER PUBLICATIONS

International Search Report and Written Opinion for Application No. PCT/US2013/072543 dated Mar. 6, 2014.
Premier Medical : Dermatology [online] [retrieved May 5, 2014]. Retrieved via the Internet Archive Wayback Machine at http://web.archive.org/web/20080905050213/http://www.premusa.com/medical/dermatology.asp. (Sep. 5, 2008) 2 pages.

* cited by examiner

*Primary Examiner* — Mohammad M Ali
(74) *Attorney, Agent, or Firm* — Alston & Bird LLP

(57) ABSTRACT

A blanket for cryogenically cooling at least a portion of a workpiece is provided. The blanket includes a body having an interior surface configured to face the workpiece. The blanket also includes a plurality of nozzles located on the interior surface of the body. The blanket further includes one or more tubes configured to deliver cryogenic liquid to the plurality of nozzles for spraying upon at least a portion of the workpiece. A method and system for cryogenically cooling at least a portion of a workpiece utilizing a blanket are also provided.

19 Claims, 3 Drawing Sheets

BLANKET FOR CRYOGENICALLY COOLING AT LEAST A PORTION OF A WORKPIECE

TECHNOLOGICAL FIELD

An example embodiment of the present disclosure relates generally to cryogenically cooling a workpiece and, more particularly, to a blanket for cryogenically cooling at least a portion of a workpiece.

BACKGROUND

A variety of workpieces may be required to be cryogenically cooled for various purposes, such as during different manufacturing or inspection operations. To evaluate the bond between the metal and composite portions of a workpiece, the workpiece may be cryogenically cooled to allow the metal and the composite portions thereof to be physically separated without damaging the structure of the bond region therebetween.

In order to cryogenically cool a workpiece, the workpiece may be submerged within a bath of cryogenic liquid, such as a bath of liquid carbon dioxide or liquid nitrogen. In order to submerge the workpiece within the bath of cryogenic liquid, the bath must generally be larger than the workpiece and, as a result, may disadvantageously consume valuable floor space as a result of the bath's relatively large footprint. In order to submerge a workpiece within the bath of cryogenic liquid, the workpiece is typically transported to the bath and handled in such a manner as to be controllably submerged within the bath and then withdrawn from the bath following the cooling of the workpiece. The amount of cryogenic liquid, such as liquid nitrogen or liquid carbon dioxide, should also be correspondingly large to permit the workpiece to be fully submerged therein. In instances in which the workpiece is relatively large and/or heavy, the transportation of the workpiece to the bath and the handling of the workpiece in conjunction with its submersion within the bath may also require correspondingly large and, in some instances, complex equipment to interact with the workpiece.

A spray gun may alternatively be utilized in order to spray liquid cryogen upon a portion of a workpiece. The spray gun generally applies the liquid nitrogen on a small area of the workpiece. Accordingly, the spray gun must be continuously moved over the surface of the workpiece to cool a larger portion of the workpiece. The movement of the spray gun across the surface of the workpiece may increase the time required to cryogenically cool the workpiece and may prevent all portions of the workpiece from being cryogenically cooled simultaneously. The spray gun also generally includes a canister that provides the cryogenic liquid to be sprayed upon the workpiece, thereby increasing the weight of the spray gun. The spray gun may thus be limited by the capacity of the canister.

BRIEF SUMMARY

A method and system for cryogenically cooling at least a portion of a workpiece utilizing a blanket are provided in accordance with the various aspects of the present disclosure. The blanket may cover and correspondingly cause at least a portion of a workpiece to be cryogenically cooled. The blanket according to some aspects of the disclosure may conform to the contour of the workpiece, thereby permitting a variety of workpieces, including irregularly shaped workpieces, to be cryogenically cooled. The blanket may be portable and, as a result, may be moved from workpiece to workpiece such that the workpiece need not be transported to the source of cryogenic liquid, but, instead, the blanket may be taken to and placed adjacent the workpiece in order to facilitate the cryogenic cooling of the workpiece. As a result of the mobility of the blanket, the footprint required by the cryogenic cooling system and method of one or more aspects of the present disclosure may be meaningfully reduced in comparison to baths of cryogenic liquid that may otherwise be utilized to cool a workpiece.

In one example, a system for cryogenically cooling at least a portion of the workpiece is provided. The system includes a blanket having an inner surface configured to face the workpiece. The inner surface of the blanket includes a plurality of nozzles. The system according to this aspect of the disclosure also includes one or more sources of a liquid cryogen. Further, the exemplary system includes one or more tubes connecting the one or more sources of liquid cryogen to the plurality of nozzles in order to permit liquid cryogen to be sprayed upon at least a portion of the workpiece via the plurality of nozzles.

The blanket of one aspect of the disclosure may be formed of a pliable material to conform to at least the portion of the workpiece. The blanket of another aspect of the disclosure may be formed of a rigid material which may, in one example, have a shape that matches at least a portion of the workpiece. In one example, the one or more tubes may include a manifold for directing the liquid cryogen to the plurality of nozzles. Alternatively, the one or more tubes may include a plurality of tubes extending from the one or more sources of the liquid cryogen to the blanket with each tube configured to provide liquid cryogen to a respective nozzle. The one or more sources of liquid cryogen may be positioned relative to the blanket such that the liquid cryogen is gravity fed to the nozzles.

In another example, a blanket for cryogenically cooling at least a portion of a workpiece is provided. The blanket includes a body having an interior surface configured to face the workpiece. The blanket also includes a plurality of nozzles on the interior surface of the body. The blanket according to this aspect of the disclosure further includes one or more tubes configured to deliver cryogenic liquid to the plurality of nozzles for spraying upon at least a portion of the workpiece.

The blanket of one aspect of the disclosure may be formed of a pliable material to conform to at least the portion of the workpiece. The blanket of another aspect of the disclosure may be formed of a rigid material which may, in one example, have a shape that matches at least a portion of the workpiece. In one example, the one or more tubes may include a manifold for directing the liquid cryogen to the plurality of nozzles.

In a further example, a method for cryogenically cooling at least a portion of a workpiece is provided. The method includes positioning a blanket upon at least a portion of the workpiece such that an inner surface of the blanket that includes a plurality of nozzles faces the workpiece. The exemplary method also includes providing one or more sources of a liquid cryogen and causing the liquid cryogen to be delivered from the one or more sources to the plurality of nozzles. The method also includes spraying the liquid cryogen upon at least a portion of the workpiece via the plurality of nozzles.

The method according to one example may position the blanket by positioning the blanket formed of a pliable material adjacent at least a portion of the workpiece such that the blanket conforms to at least the portion of the workpiece. The method according to another aspect of the disclosure may position the blanket by positioning the blanket formed of a rigid material adjacent at least a portion of the workpiece with the rigid material, in one example, having a shape that matches at least a portion of the workpiece. In one example, the method may cause the liquid cryogen to be delivered from the one or more sources to the plurality of nozzles by splitting the liquid cryogen provided by the one or more sources with a manifold and thereafter directing the liquid cryogen to the plurality of nozzles. Alternatively, the method may include causing the liquid cryogen to be delivered from the one or more sources to the plurality of nozzles by delivering liquid cryogen to each nozzle via a respective tube that extends from the at least one source. In one example, the method may cause liquid cryogen to be delivered from the one or more sources to the plurality of nozzles by gravity feeding the liquid cryogen from the one or more sources to the nozzles.

BRIEF DESCRIPTION OF THE DRAWINGS

Figure 1:
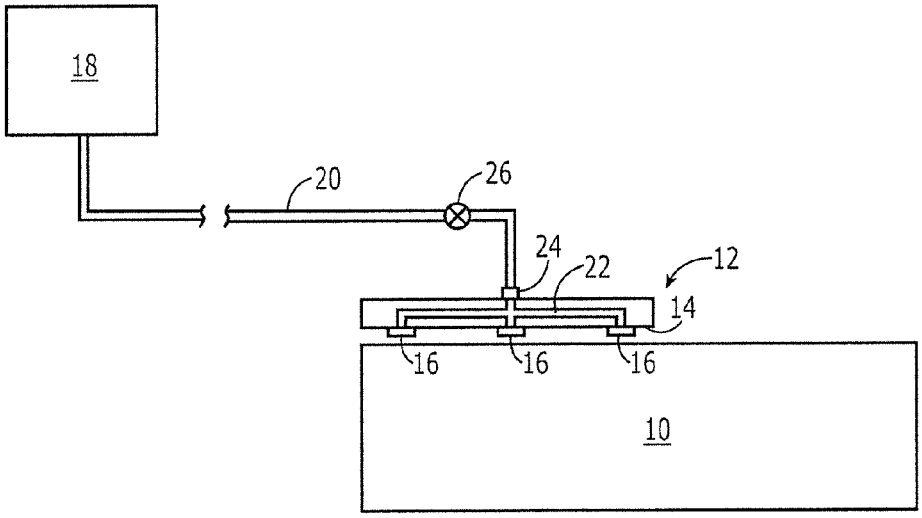
Figure 2:
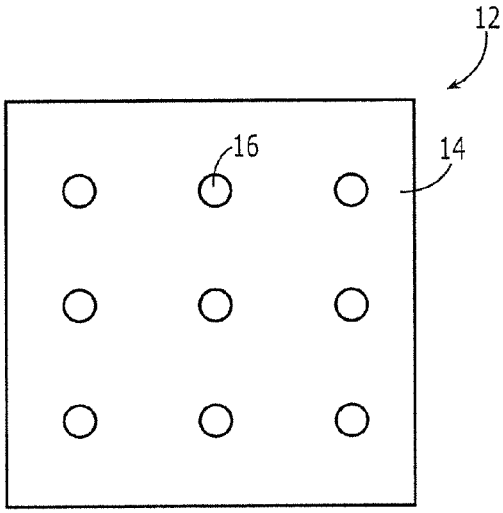
Figure 3:
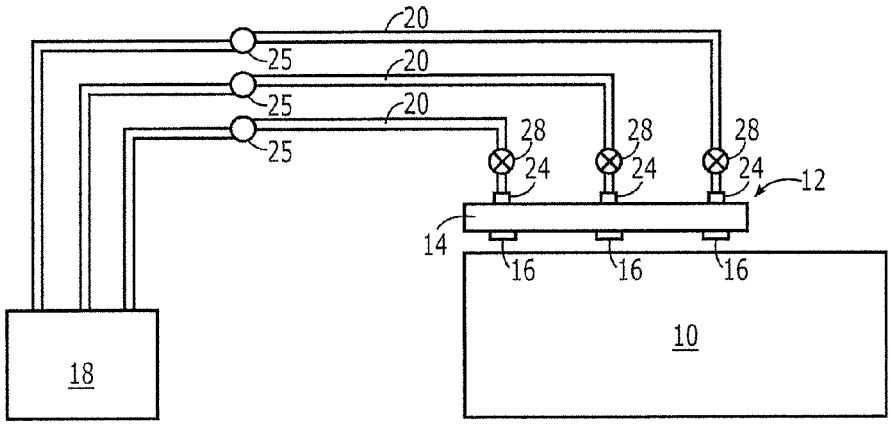
Figure 4:
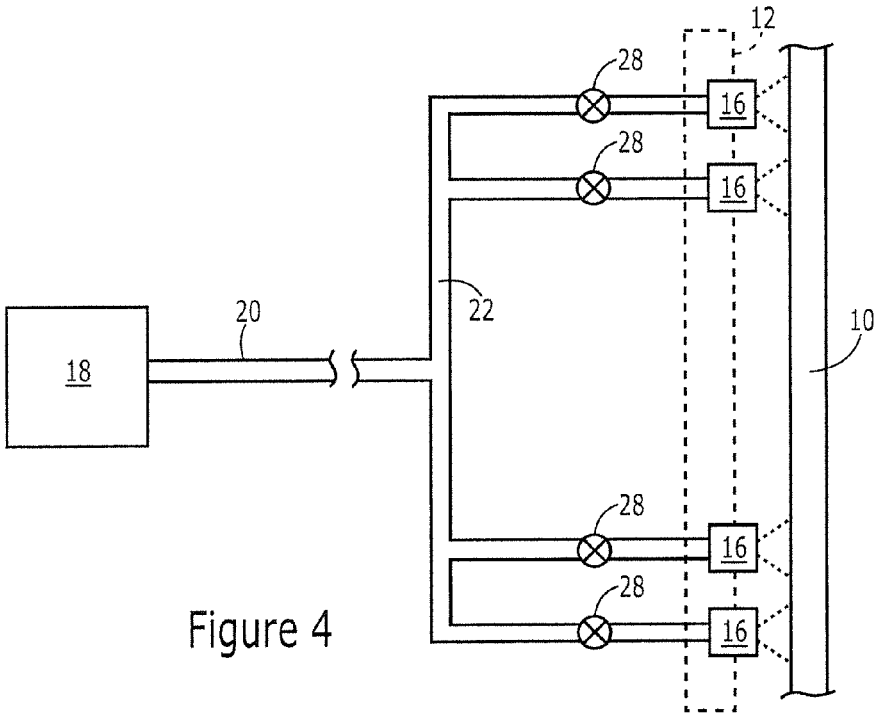
Figure 5:
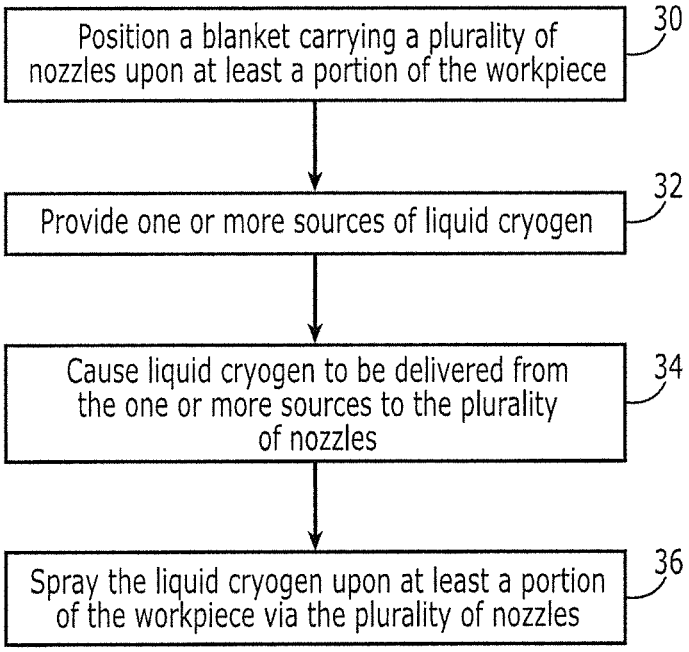

Having thus described certain examples of the present disclosure in general terms, reference will hereinafter be made to the accompanying drawings, which are not necessarily drawn to scale, and wherein:

FIG. 1 is a schematic side view of a system for cryogenically cooling at least a portion of a workpiece utilizing a blanket in accordance with one example of the present disclosure;

FIG. 2 is a plan view of a blanket in accordance with an example of the present disclosure;

FIG. 3 is a schematic side view of a system for cryogenically cooling at least a portion of a workpiece utilizing a blanket in accordance with another example of the present disclosure;

FIG. 4 is a schematic representation of a system for cryogenically cooling at least a portion of a workpiece in accordance with an example of the present disclosure; and FIG. 5 is a flowchart illustrating operations performed in order to cryogenically cool at least a portion of a workpiece in accordance with an example of the present disclosure.

DETAILED DESCRIPTION

The aspects of the disclosure now will be described more fully hereinafter with reference to the accompanying drawings, in which some, but not all examples are shown. Indeed, this disclosure may be embodied in many different forms and should not be construed as limited to the examples set forth herein; rather, these examples are provided so that this disclosure will satisfy applicable legal requirements. Like numbers refer to like elements throughout.

A system and method for cryogenically cooling at least a portion of a workpiece utilizing a blanket that carries a plurality of nozzles for spraying the liquid cryogen upon the workpiece are provided in accordance with one or more aspects of the present disclosure. The system and method may be utilized to cryogenically cool a variety of workpieces including, for example, components of a vehicle, a building or the like. Regardless of the type of workpiece, the system and method may be utilized to cryogenically cool at least a portion of a workpiece for various purposes including, for instance, manufacture and/or inspection of the workpiece. By way of example, without limitation, a workpiece may include metal and composite portions adhered to one another. In order to inspect the bond between the metal and composite portions, the workpiece may be cryogenically cooled to permit the metal and composite portions to be physically separated, e.g., detached, without damaging the structure of the bond region therebetween.

Referring now to FIG. 1, a system for cryogenically cooling at least a portion of a workpiece 10 utilizing a blanket 12 is depicted. The workpiece 10 is illustrated to be a rectangular solid by way of example only and may have any of a variety of shapes and sizes. As shown in FIG. 1, the blanket 12 may be positioned so as to face the workpiece 10, such as by being disposed adjacent a surface of the workpiece, such as upon a surface of the workpiece. Although the exemplary blanket 12 is shown to cover a portion of the workpiece 10 with other portions of the workpiece not being covered by the blanket, the blanket, in other aspects thereof, may be configured to cover the entire surface of the workpiece or greater or lesser amounts of the surface of the workpiece than is shown in FIG. 1. Additionally, while the blanket 12 of the example of FIG. 1 is shown to be placed upon an upper surface of the workpiece 10, the blanket may be positioned upon other workpiece surfaces, such as the side surfaces and/or the bottom surface of the workpiece, as necessary. Thus, the blanket 12 according to one aspect of the disclosure may include one or more fasteners (not shown) for releasably attaching the blanket to the workpiece 10. The fasteners may be mechanical fasteners that interact with corresponding features of the workpiece 10 or other types of fasteners including, for example, magnetic fasteners or a vacuum or other suction-based system for temporarily attaching the blanket 12 to the workpiece.

The blanket 12 includes a body having opposed interior and exterior surfaces. In this regard, the interior surface 14 of the blanket is configured to face the workpiece 10. The body of the blanket 12 may be formed of various materials which do not chemically react and are not otherwise damaged by the liquid cryogen. In one example, the body of the blanket 12 may be formed of a pliable material. For example, the body of the blanket 12 may be a thermal blanket formed of silicone rubber. As a result of the pliable nature of the body of the blanket according to one aspect of the disclosure, the blanket may conform to at least the portion of the workpiece 10 upon which the blanket is placed including, for example, workpieces having irregular and/or complex contours. Thus, the blanket 12, in this example, may cover one or more portions of a workpiece, such as the workpiece 10 that is irregularly shaped, thereby increasing the variety of workpieces with which the blanket may be utilized. Alternatively, the body of the blanket 12 may be formed of a rigid material, such as a metallic or plastic material. In one example, the body of a blanket 12, formed of a rigid material, may have a shape that matches the shape of at least that portion of the workpiece 10 upon which the blanket is placed.

As shown in FIG. 1 and, in more detail, in FIG. 2, the blanket 12 includes a plurality of nozzles 16 on the interior surface 14 of the body of the blanket. The plurality of nozzles 16 may include any number of nozzles which may be arranged in any configuration. In one example, however, the plurality of nozzles 16 is arranged in a grid or an array with each nozzle spaced an equal distance from its neighboring nozzles as shown, for example, in FIG. 2. The spacing of the nozzles 16 may be based, at least in part, upon the spray pattern generated by the nozzles. In this regard, the nozzles 16 may be spaced relative to one another such that the spray patterns produced by the nozzles cover the entire surface of that portion of the workpiece 10 covered by the blanket 12 such that the portion of the workpiece covered by the blanket is relatively uniformly cooled by the liquid cryogen. In order to facilitate the consistent coverage of that portion of the workpiece 10 covered by the blanket 12 with liquid cryogen, the blanket 12 may be spaced apart from the surface of the workpiece. Alternatively, the blanket 12 may be placed directly upon the surface of the workpiece 10.

As shown in FIG. 1, the system for cryogenically cooling at least a portion of a workpiece 10 also includes one or more sources 18 of the liquid cryogen. The sources 18 of liquid cryogen may include a tank, a canister or other container of liquid cryogen. The source 18 may also provide different types of liquid cryogen, including liquid carbon dioxide, liquid nitrogen or the like. The source 18 of liquid cryogen may be relatively close to the workpiece 10 and the blanket 12 that is disposed adjacent at least a portion of the workpiece or may be remote from the workpiece. In either instance, the system for cryogenically cooling at least a portion of the workpiece 10 also includes one or more tubes 20 connecting the one or more sources 18 of liquid cryogen to the plurality of nozzles 16. The tubes 20 may be formed of a material, such as glass epoxy, that does not chemically react with the liquid cryogen and is not otherwise damaged by contact with the liquid cryogen.

As shown in FIG. 3, each nozzle 16 may be separately connected to the source 18 of liquid cryogen by a respective tube 20. Thus, a plurality of tubes 20 may extend from the source 18 of liquid cryogen to the blanket 12. Alternatively, a single tube 20 or at least a smaller number of tubes than the number of nozzles 16 on the blanket 12 may connect the source 18 of liquid cryogen to the nozzles. In an example where a single tube 20 connects the plurality of nozzles 16 with the source 18 of liquid cryogen, the one or more tubes may include a manifold 22 for splitting the liquid cryogen delivered via the single tube 20 from the source 18 of liquid cryogen for delivery to each of the plurality of nozzles 16, as shown, for example, in FIGS. 1 and 4. Accordingly, the exterior surface of the blanket 12 may include a liquid-tight connection 24 for connecting the tube 20, that extends from the blanket to the source 18 of liquid cryogen, to the manifold 22. In this aspect, the blanket 12 may include one or more tubes extending through the body of the blanket for coupling the connection 24, located on the external surface of the blanket, with the plurality of nozzles 16, located on the inner surface 14 of the blanket. As stated above, the blanket 12, in one aspect thereof, may include the manifold 22, as shown in FIGS. 1 and 4, disposed within the blanket for distributing the liquid coolant to each of the plurality of nozzles 16.

The liquid cryogen may be delivered from the source 18 to the nozzles 16 in a number of ways. For example, the source 18 may be positioned relative to the nozzles 16, such as by positioning the source higher than the nozzles, such that the liquid cryogen is gravity fed to the nozzles, as shown in FIG. 1. Additionally or alternatively, the system may include one or more pumps 25 configured to urge the liquid cryogen through the tubes 20 from the source 18 to the nozzles 16, as shown in FIG. 3.

In operation, the blanket 12 may be positioned adjacent at least a portion of the workpiece 10 such that the interior surface 14 of the blanket that includes the plurality of nozzles 16 faces the workpiece, as shown in FIG. 1. See block 30 of FIG. 5. The blanket 12 may be portable and, as a result, may be moved to the location of the workpiece 10. Thus, the movement of the blanket 12 to the workpiece 10 may reduce or eliminate the requirement to move the workpiece in order to cryogenically cool the workpiece. Additionally, because of its portability, the blanket 12 does not occupy much space and, as a result, need not have a footprint of the type generally required by baths of liquid cryogen. As noted above, one or more sources 18 of the liquid cryogen are also provided, as shown in block 32 of FIG. 5. The sources 18 of liquid cryogen may be close to the workpiece 10 or may be remote therefrom. As shown in block 34 of FIG. 5, liquid cryogen may be caused to be delivered from the one or more sources 18 to the plurality of nozzles 16, such as via one or more tubes 20 that extend from the one or more sources of liquid cryogen to the blanket 12. The liquid cryogen may then be sprayed upon at least a portion of the workpiece 10 via the plurality of nozzles 16. See block 36 of FIG. 5. As noted above, the plurality of nozzles 16 may be positioned such that the liquid cryogen dispensed from the plurality of nozzles covers the entire surface of the workpiece 10 that is covered by the blanket 12, thereby providing for relatively uniform cooling of the portion of the workpiece covered by the blanket.

The system for cryogenically cooling at least a portion of a workpiece 10 may be configured to control the delivery of coolant to the workpiece 10 and, as such, may include one or more switches for controlling the flow of coolant. In one example, depicted in FIG. 1, the system may include a single switch 26 for controlling the flow of liquid cryogen from the source 18 of liquid cryogen to the blanket 12 for distribution via the plurality of nozzles 16. Alternatively or additionally, a switch 28, as shown in FIG. 4, may be associated with each nozzle 16 or with subsets of the nozzles in order to provide more specific control of the delivery of liquid cryogen via a particular nozzle to the corresponding portion of the workpiece 10. In this example, the delivery of liquid cryogen to the individual nozzles 16 (only four of which are shown) may be controlled such that liquid cryogen may be only delivered to some, but not all of the nozzles, such as in an instance in which the blanket 12 (shown in dashed lines in FIG. 4) is larger than that portion of the workpiece 10 to be cryogenically cooled. In this regard, the switches 28 may be configured to only deliver liquid cryogen to the nozzles 16 that overlie the smaller portion of the workpiece 10 that is to be cryogenically cooled.

Many modifications of the various aspects of the disclosure set forth herein will become apparent to one skilled in the art to which this disclosure pertains, having the benefit of the teachings presented in the foregoing description and the associated drawings. Therefore, it is to be understood that the disclosure is not to be limited to the specific examples presented herein and that modifications and other embodiments are intended to be included within the scope of the appended claims. Although specific terms are employed herein, they are used in a generic and descriptive sense only and not for purposes of limitation.

What is claimed is:

1. A system for cryogenically cooling at least a portion of a workpiece, the system comprising:

a blanket having an exterior surface and an opposed inner surface configured to face the workpiece, wherein the inner surface of the blanket comprises a plurality of nozzles, and wherein the blanket is discrete and separable from the workpiece and is portable so as to be movable to a location of the workpiece;

one or more sources of a liquid cryogen; and one or more tubes connecting the one or more sources of the liquid cryogen to the plurality of nozzles in order to permit the liquid cryogen to be sprayed upon at least a portion of the workpiece via the plurality of nozzles such that the liquid cryogen is sprayed directly onto and into direct contact with at least the portion of the workpiece.

2. The system according to claim 1 wherein the blanket comprises a pliable material to conform to at least the portion of the workpiece.

3. The system according to claim 1 wherein the blanket comprises a rigid material.

4. The system according to claim 3 wherein the rigid material of the blanket has a shape that matches at least the portion of the workpiece.

5. The system according to claim 1 wherein the one or more tubes comprises a manifold for directing the liquid cryogen to the plurality of nozzles.

6. The system according to claim 1 wherein the one or more tubes comprises a plurality of tubes extending from the one or more sources of the liquid cryogen to the blanket, each tube configured to provide the liquid cryogen to a corresponding nozzle of the plurality of nozzles.

7. The system according to claim 1 wherein the one or more sources of the liquid cryogen are positioned relative to the blanket such that the liquid cryogen is gravity fed to the nozzles.

8. A blanket for cryogenically cooling at least a portion of a workpiece, the blanket comprising:

a body having an exterior surface and an opposed interior surface configured to face the workpiece;

a plurality of nozzles on the interior surface of the body; and one or more tubes configured to deliver cryogenic liquid to the plurality of nozzles for spraying upon at least the portion of the workpiece such that the cryogenic liquid is sprayed directly onto and into direct contact with at least the portion of the workpiece, wherein the blanket is discrete and separable from the workpiece and is portable so as to be movable to a location of the workpiece.

9. The blanket according to claim 8 wherein the blanket comprises a pliable material to conform to at least the portion of the workpiece.

10. The blanket according to claim 8 wherein the blanket comprises a rigid material.

11. The blanket according to claim 10 wherein the rigid material of the blanket has a shape that matches at least the portion of the workpiece.

12. The blanket according to claim 8 wherein the one or more tubes comprises a manifold for directing the cryogenic liquid to the plurality of nozzles.

13. A method for cryogenically cooling at least a portion of a workpiece, the method comprising:

positioning a blanket upon at least a portion of the workpiece such that an inner surface of the blanket that comprises a plurality of nozzles faces the workpiece, wherein the blanket has an exterior surface opposite the inner surface, and wherein the blanket is discrete and separable from the workpiece and is portable such that positioning the blanket upon at least a portion of the workpiece comprises moving the blanket to a location of the workpiece;

providing one or more sources of a liquid cryogen;

causing the liquid cryogen to be delivered from the one or more sources to the plurality of nozzles; and spraying the liquid cryogen upon at least a portion of the workpiece via the plurality of nozzles such that the liquid cryogen is sprayed directly onto and into direct contact with at least the portion of the workpiece.

14. The method according to claim 13 wherein positioning the blanket comprises positioning the blanket formed of a pliable material adjacent at least a portion of the workpiece such that the blanket conforms to at least the portion of the workpiece.

15. The method according to claim 13 wherein positioning the blanket comprises positioning the blanket formed of a rigid material adjacent at least a portion of the workpiece.

16. The method according to claim 15 wherein the rigid material of the blanket has a shape that matches at least the portion of the workpiece.

17. The method according to claim 13 wherein causing the liquid cryogen to be delivered from the one or more sources to the plurality of nozzles comprises splitting the liquid cryogen provided by the one or more sources with a manifold and thereafter directing the liquid cryogen to the plurality of nozzles.

18. The method according to claim 13 wherein causing the liquid cryogen to be delivered from the one or more sources to the plurality of nozzles comprises delivering the liquid cryogen to each of the plurality of nozzles via at least one tube that extends from the one or more sources of the liquid cryogen.

19. The method according to claim 13 wherein causing the liquid cryogen to be delivered from the one or more sources to the plurality of nozzles comprises gravity feeding the liquid cryogen from the one or more sources to the plurality of nozzles.

* * * * *